United States Patent [19]

Lepow

[11] 4,084,879

[45] Apr. 18, 1978

[54] FOIL TERMINAL BLOCK

[75] Inventor: Mark Norman Lepow, Santa Ana, Calif.

[73] Assignee: American Security Equipment Company, Carson, Calif.

[21] Appl. No.: 780,477

[22] Filed: Mar. 23, 1977

[51] Int. Cl.[2] ..... H01R 9/18

[52] U.S. Cl. ..... 339/198 GA; 339/119 R; 339/272 A

[58] Field of Search ..... 339/119 R, 198, 276 SF, 339/272 A; 29/623

[56] References Cited

U.S. PATENT DOCUMENTS

| | | | |
|---|---|---|---|
| 2,923,913 | 2/1960 | Kulka | 339/198 R |
| 3,078,438 | 2/1963 | Szental | 339/198 R |
| 3,417,192 | 12/1968 | Elm | 339/198 X |
| 3,512,121 | 5/1970 | Bergeron | 339/198 E |
| 3,980,384 | 9/1976 | Lawson | 339/198 GA |

FOREIGN PATENT DOCUMENTS

| | | | |
|---|---|---|---|
| 274,764 | 9/1965 | Australia | 339/198 |

*Primary Examiner*—Roy Lake
*Assistant Examiner*—E. F. Desmond
*Attorney, Agent, or Firm*—Keith D. Beecher

[57] ABSTRACT

A self-adhesive electrical terminal block is provided for making electrical connections to burglar alarm foil strips on glass windows, glass doors, and the like. The terminal blocks of the invention are constructed as detachable pairs. Each pair may be used to connect to a foil whenever both ends of the foil are brought off the same side of the glass; and the individual pairs may be separated into single blocks to connect to a foil when the ends of the foil are brought off opposite ends of the glass. The terminal blocks of the invention are constructed to be sold in strips on a single adhesive base to facilitate handling. A channel is formed in the top of the individual blocks to receive the ends of the foil and to facilitate connecting the foil to the block. The individual blocks, in addition to being provided with pressure-sensitive adhesive strips to permit the blocks to be attached to the glass, are also provided with mounting holes to permit mounting of the blocks to adjacent window or door frames, if so desired.

4 Claims, 3 Drawing Figures

FOIL TERMINAL BLOCK

BACKGROUND OF THE INVENTION

It has long been the practice in the burglar alarm art to attach electrically conductive foil strips around the margins of glass windows and glass doors. The foil strips are connected into an electric burglar alarm circuit. Then, if the window should be broken, the strip also breaks and causes an electric burglar alarm to be activated.

Self-adhesive terminal blocks have been provided in the prior art, which may be directly mounted on the glass, and which may be used to establish electrical connections to the foil strips. Such terminal blocks are usually formed with a base of an appropriate molded plastic material, and with a metal clamp and connector screw mounted on the base. The end of the foil strip is brought up a ramp on the base under the clamp, and the screw is threaded into the base through a hole in the end of the foil strip. The connecting wire is wrapped around the screw, and when the screw is tightened down into the base, it serves as a terminal for the wire, and also causes the clamp to hold the end of the foil strip firmly in place on the terminal block.

The prior art terminal blocks of the type described above are supplied as single blocks which may be used to establish electrical connection to a foil strip when the ends of the strip are brought off opposite ends of the glass, with one block being provided at each end. The prior art terminal blocks are also supplied as double blocks which may be used to establish electrical connections to a foil strip when both ends of the strip are brought off the same side of the glass.

In either case, the base of the single or double prior art blocks is adhesively attached to the glass at the edge of the window or door, with the metal clamping plate and screw removed. The end of the foil strip is then brought up over the edge of the base and up the sloped ramp on the base. The metal clamp is then replaced, and the screw is threaded through the plate and through the end of the foil strip into the base. The circuit wire, as mentioned above, is connected under the screw.

The terminal blocks of the present invention are advantageous in that they are constructed as detachable double blocks so that there is no need for the installer to purchase quantities of single and double blocks, as is the case in the prior art. Instead, the purchaser obtains only the double blocks of the invention, which he uses in the same applications as the double blocks of the prior art, and which he separates into single blocks only if and when the need arises.

The double blocks of the present invention are preferably sold as strips of a selected number of double blocks supported on a single adhesive strip to facilitate handling of the blocks. The installer merely selects a number of strips representing the terminal blocks required for any particular job. He then separates the double blocks from the strip as each is to be mounted in place, and separates the double blocks into single blocks if or when the requirement arises.

Another feature of the terminal block of the invention is that, in addition to being provided with a pressure-sensitive adhesive strip to permit the block to be mounted directly on the glass, the block is also provided with mounting holes to permit it to be mounted on the adjacent window or door frame, if so desired.

The base of the terminal block of the invention is formed of an appropriate molded plastic material, and is configured to define a channel across the top of the block to receive and guide the end of the foil strip in place over the top of the ramp, and which facilitates the operations required to attach the strip to the terminal block.

DETAILED DESCRIPTION OF THE ILLUSTRATED EMBODIMENT

Figure 1:
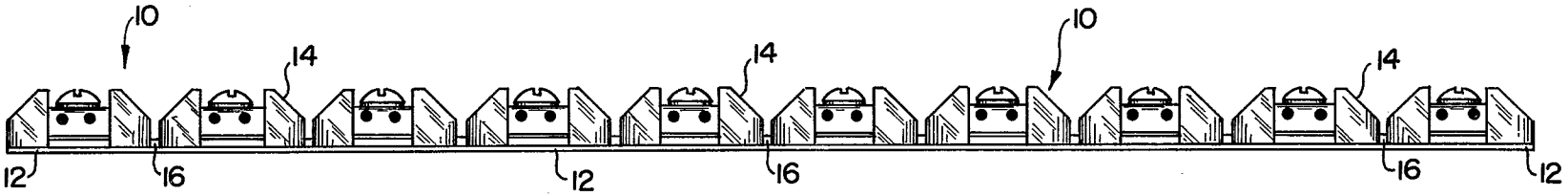
FIG. 1 is a perspective representation of a strip of a plurality of double terminal blocks constructed in accordance with the invention, and supported on a common strip of pressure-sensitive material.

As shown in FIG. 1, a plurality of double terminal blocks 10, each constructed in accordance with the concepts of the present invention are mounted on a single strip 12 of pressure-sensitive adhesive material. As mentioned above, the double terminal blocks are mounted on the common adhesive strip 12 to facilitate handling. The common strip 12 is provided with parting lines to permit the double blocks 10 to be removed from the common strip 12 as they are used on the job.

Figure 2:
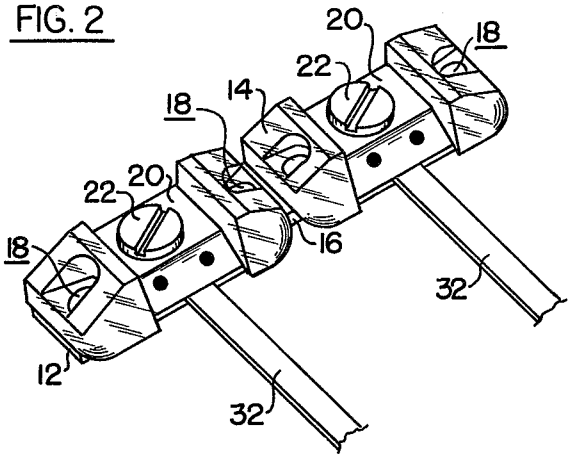
FIG. 2 is a perspective representation of a double terminal block constructed in accordance with the invention.

As shown in FIG. 2, each double terminal block of the invention has a base 14 formed of appropriate molded plastic material, and which has a parting line 16 extending across the base to permit the two terminal blocks to be separated from one another so as to constitute single terminal blocks, if or when the need arises.

Each double terminal block in FIG. 2, in addition to being provided with the strip of pressure-sensitive adhesive 12, to permit the block to be adhesively attached to window pane, is provided with a plurality of holes 18 to permit the block to be mounted to an adjacent door frame or window frame, if so desired.

Each terminal block is provided with a clamping plate 20 formed of appropriate electrically conductive material, such as chrome plated bronze, and each is provided with a mounting screw 22 which extends through the mounting plate, and mounts the plate to the base.

Figure 3:
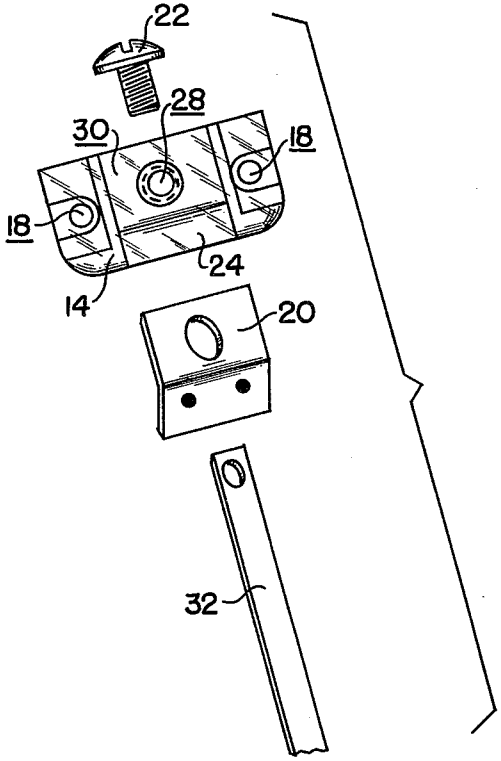
FIG. 3 is a detached perspective representation of a single terminal block, likewise constructed in accordance with the concepts of the invention.

The base of each terminal block is formed to define a ramp 24 which slopes upwardly from the forward edge of the base (FIG. 3). The screw 22 is threaded into a hole 28 in the base at the top of the ramp. The base is also formed to define a channel 30 extending across the base at the top of the ramp to receive and guide the end of the foil strip 32 which is to be connected to the terminal block.

The invention provides, therefore, an improved terminal block which has particular utility in connecting electric wires to the ends of electrically conductive foil strips mounted on glass panes in a burglar alarm system.

It will be appreciated that although a particular embodiment of the invention has been shown and described, modifications may be made. It is intended in the claims to cover all modifications which come within the true spirit and scope of the invention.

What is claimed is:

1. A terminal block assembly for establishing electrical connections to an electrically conductive foil strip mounted on a pane of glass, said foil strip having an end with a hole therein, said assembly comprising: a base formed of molded plastic material and defining a pair of adjacent terminal blocks with a parting line therebetween to permit the blocks to be separated from one another, said base further defining a ramp for each of the terminal blocks sloping upwardly from the forward edge of the base, and said base defining a channel at the top of the ramp of each of the terminal blocks to receive the end of the foil strip; an electrically conductive bent-over clamping plate for each of said terminal blocks separated from the base, so that the end of the foil strip may extend up the ramp and across the base under the clamp; and a screw for each of said terminal blocks extending through the clamping plate and through the hole in the end of the foil strip into said base to mount the clamping plate on the base and extending over the corresponding ramp in clamping relationship with the end of the foil strip.

2. The terminal block assembly defined in claim 1, and which includes a strip of pressure-sensitive adhesive mounted on the bottom of the base to provide a mounting means for the assembly on the pane of glass.

3. The terminal block assembly defined in claim 1, in which the base has mounting holes therethrough for each of the terminal blocks.

4. The terminal block assembly defined in claim 1, and which includes a strip of pressure-sensitive adhesive mounted on the bottom of the base and elongated to support a plurality of similar bases in an elongated strip-like configuration.

* * * * *